US008015780B2

(12) United States Patent
Cook et al.

(10) Patent No.: US 8,015,780 B2
(45) **Date of Patent: *Sep. 13, 2011**

(54) PORTABLE FOOD DISPENSER

(75) Inventors: Matthew R. Cook, Hinsdale, IL (US); Kurt Wolf, Evanston, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/558,974

(22) Filed: Sep. 14, 2009

(65) Prior Publication Data

US 2010/0139220 A1 Jun. 10, 2010

Related U.S. Application Data

(60) Continuation of application No. 11/954,544, filed on Dec. 12, 2007, now Pat. No. 7,587,883, which is a division of application No. 10/808,214, filed on Mar. 24, 2004, now Pat. No. 7,325,718.

(60) Provisional application No. 60/471,437, filed on May 16, 2003.

(51) Int. Cl.
*B65B 7/24* (2006.01)

(52) U.S. Cl. ..... 53/491; 53/467; 53/484; 229/103

(58) Field of Classification Search ..... 53/449, 53/491; 206/139; 229/101.2, 103
See application file for complete search history.

(56) References Cited

U.S. PATENT DOCUMENTS

| | | | |
|---|---|---|---|
| 1,149,891 | A | 8/1915 | Billstein |
| 1,902,262 | A | 3/1933 | Powell |
| 2,341,762 | A | 2/1944 | Conklin |
| 3,021,976 | A | 2/1962 | Tracy |
| 3,207,414 | A | 9/1965 | Locke et al. |

(Continued)

FOREIGN PATENT DOCUMENTS

GB 1 385 484 2/1975

(Continued)

OTHER PUBLICATIONS

International Search Report from corresponding international application No. PCT/US2004/014936.

(Continued)

*Primary Examiner* — Paul Durand
*Assistant Examiner* — Gloria R Weeks
(74) *Attorney, Agent, or Firm* — Brinks Hofer Gilson & Lione

(57) ABSTRACT

A portable food dispenser includes one or more containers. A first container is capable of being only partially opened to provide access to food or a second container. The second container includes a cover that can be opened to provide access to food.

7 Claims, 11 Drawing Sheets

U.S. PATENT DOCUMENTS

| | | | |
|---|---|---|---|
| 3,307,602 | A | 3/1967 | Boster |
| 3,580,466 | A | 5/1971 | Thelen |
| 3,720,343 | A | 3/1973 | Irish, Jr. |
| 3,844,861 | A | 10/1974 | Irish, Jr. |
| 3,871,568 | A | 3/1975 | Bahler |
| 4,053,052 | A | 10/1977 | Jasper |
| 4,088,262 | A | 5/1978 | Kuehlhorn |
| 4,238,069 | A | 12/1980 | Morris, Jr. |
| 4,555,037 | A | 11/1985 | Rhees |
| 4,558,528 | A | 12/1985 | Cunningham |
| 4,860,947 | A | 8/1989 | Wauters |
| 5,145,091 | A | 9/1992 | Meyers |
| 5,427,308 | A | 6/1995 | Swift et al. |
| 5,462,169 | A | 10/1995 | Dygert et al. |
| 5,520,284 | A | 5/1996 | Gray |
| 5,524,816 | A | 6/1996 | Zriny |
| 5,588,587 | A | 12/1996 | Stier et al. |
| 5,642,833 | A | 7/1997 | Ring |
| 5,775,575 | A | 7/1998 | Dorman et al. |
| 6,059,179 | A | 5/2000 | Giampapa |
| 6,325,210 | B1 | 12/2001 | Henry et al. |
| 6,336,584 | B1 | 1/2002 | Roch et al. |
| 6,652,134 | B2 | 11/2003 | Lloyd |
| 7,325,718 | B2 | 2/2008 | Cook et al. |
| 2006/0266811 | A1 | 11/2006 | Clegg et al. |
| 2006/0272959 | A1 | 12/2006 | Davis |

FOREIGN PATENT DOCUMENTS

| | | |
|---|---|---|
| GB | 2204023 | 11/1988 |
| GB | 2 302 534 | 1/1997 |
| WO | WO 96/30283 | 10/1996 |

OTHER PUBLICATIONS

Canadian Office Action from Canadian Pending Application 2,662,232, mailed Feb. 17, 2011.

PORTABLE FOOD DISPENSER

RELATED APPLICATIONS

The present patent document is a Continuation of U.S. patent application Ser. No. 11/954,544, filed Dec. 12, 2007, now U.S. Pat. No. 7,587,883, issue date Sep. 15, 2009, which is a Divisional of U.S. application Ser. No. 10/808,214, filed Mar. 24, 2004, now U.S. Pat. No. 7,325,718, issue date Feb. 5, 2008 and claims the benefit of Provisional U.S. Patent Application Ser. No. 60/471,437, filed May 16, 2003, which are incorporated herein.

BACKGROUND OF THE INVENTION

This invention relates to portable food containers and dispensers. Many food products are packaged in portable food containers and sold by restaurants for take-out or delivery. It is preferable that such containers be easy to fill, attractive, and easy to use by the consumer. In some applications, the container must also function as a bulk food dispenser. In these situations, it must be easy and convenient for a number of people to serve themselves food from the containers without making a mess and without the food cooling down, or heating up, as the case may be. It is particularly difficult to satisfy these goals when the food is a liquid, such as soup.

BRIEF SUMMARY OF THE INVENTION

A portable food dispenser has a first container and a second container. The first container has a top opening. A lid for the top opening of the first container is operational between a first position, a second position, and a third position. When the lid is in the first position it covers substantially all of the top opening of the first container. When the lid is in the second position it covers only a portion of the top opening of the first container. When the lid is in the third position substantially all of the top opening of the container is uncovered. The second container fits inside the first container and has a cover. At least a portion of the cover can be removed to provide access to food in the second container.

In another embodiment, the portable food dispenser consists of one container. The container has a top opening. A lid for the top opening of the container is operational between a first position, a second position, and a third position. When the lid is in the first position it covers substantially all of the top opening of the container. When the lid is in the second position it covers only a portion of the top opening of the container. When the lid is in the third position substantially all of the top opening of the container is uncovered.

DETAILED DESCRIPTION OF THE PREFERRED EMBODIMENTS OF THE INVENTION

Figure 1:
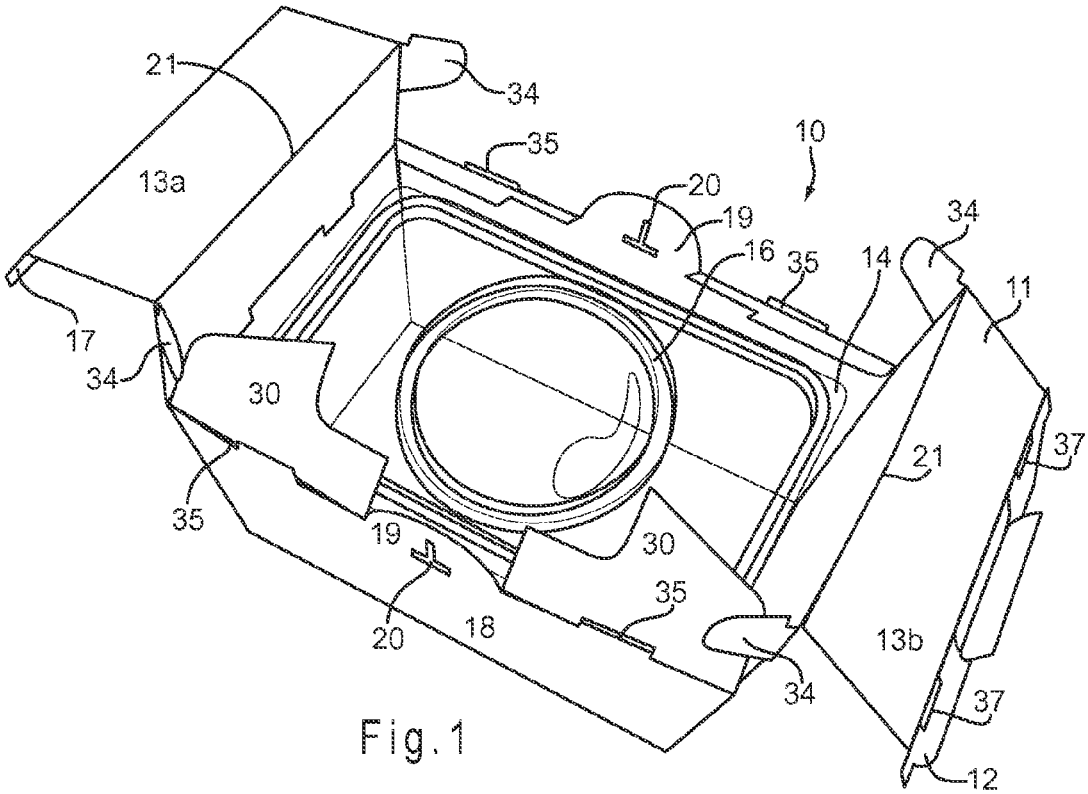
FIG. 1 is a perspective view of a first embodiment of the present invention with the lid open.
Figure 2:
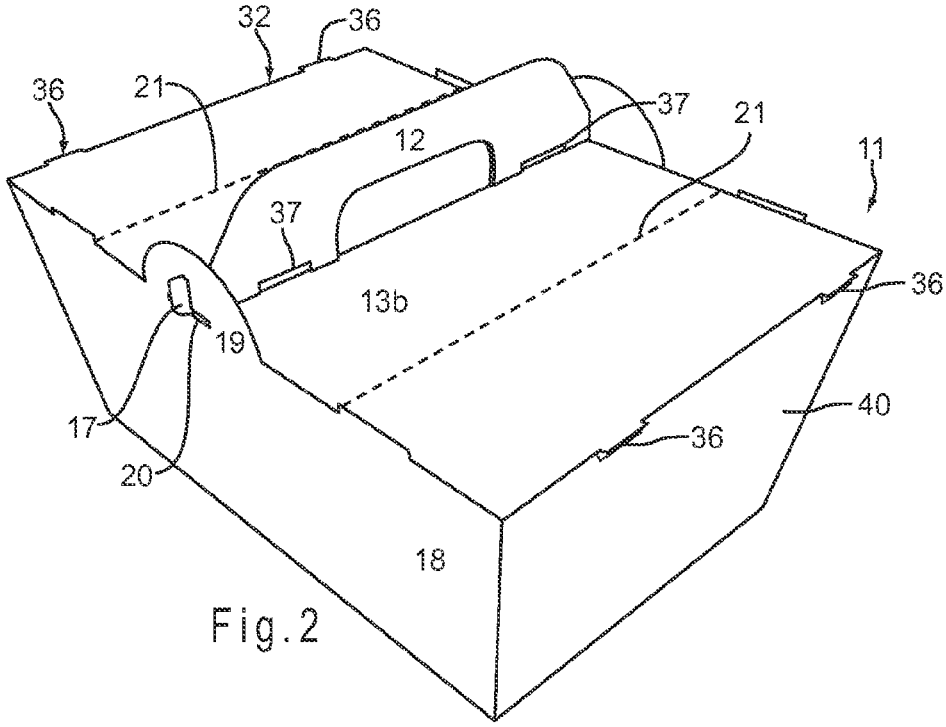
FIG. 2 is a perspective view of a first embodiment of the present invention with the lid closed.
Figure 3:
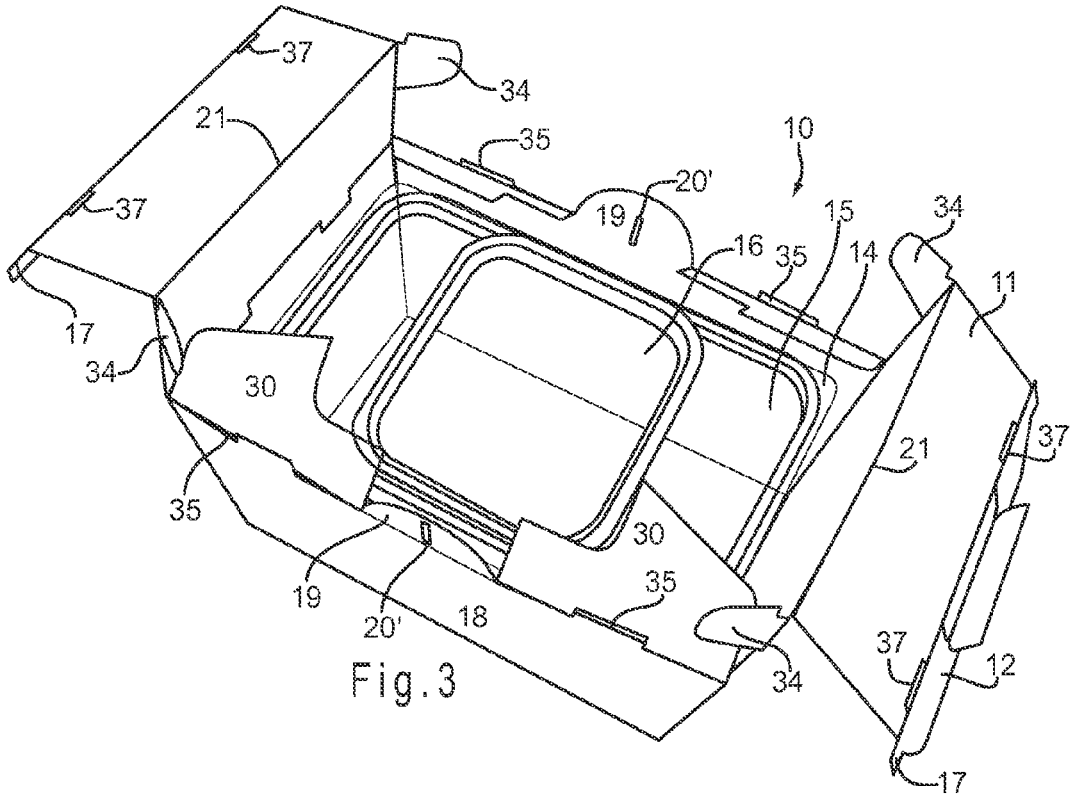
FIG. 3 is a perspective view of a second embodiment of the present invention with the lid open.

A first embodiment of the invention is shown in FIG. 1. The portable food dispenser 10 includes a first container 11 with handles 12. The lid 13 of the first container 11 consists of flaps 13*a* and 13*b*. A second container 14 is located inside the first container 11. Second container 14 includes a cover 15 and a cap 16. FIG. 2 shows the portable food dispenser 10 in its fully assembled state. Corresponding figures of a second embodiment of the invention are shown in FIGS. 3 and 4.

A method of using the portable food dispenser 10 will be provided first before describing the construction and assembly of the portable food dispenser 10 below. The second container 14 (shown separately in FIG. 5) is intended to contain food. The present invention is most useful when used with soup or the like, but the present invention can be used to deliver and serve any type of food. It is not material to the invention how or when the food is placed in the first container. Food can be placed inside the second container 14 and then the second container placed inside the first container 11. Alternatively, the empty second container 14 can be placed inside the first container 11 and then filled with food. After the second container 14 is filled with food, it is preferably covered with cover 15. If desired, the cover 15 can also be left off the second container 14.

After the second container 14 is filled with food and located inside the first container 11, the lid 13 on the first container is closed by folding flaps 13*a* and 13*b* over the opening (see FIG. 2). Handles 12 include tabs 17 and the sides 18 include tabs 19. Tabs 19 include slots 20. When the flaps 13*a* and 13*b* are folded inward to close the first container 11, tabs 17 fit into slots 20 to secure the lid 13 in a closed position. In addition, flaps 13*a* and 13*b* each include a pair of locking tabs 34 that fit within and engage a corresponding pair of locking slots 35 when the flaps 13*a* and 13*b* are closed. Handles 12 form a convenient means of carrying the portable food dispenser 10.

Figure 4:
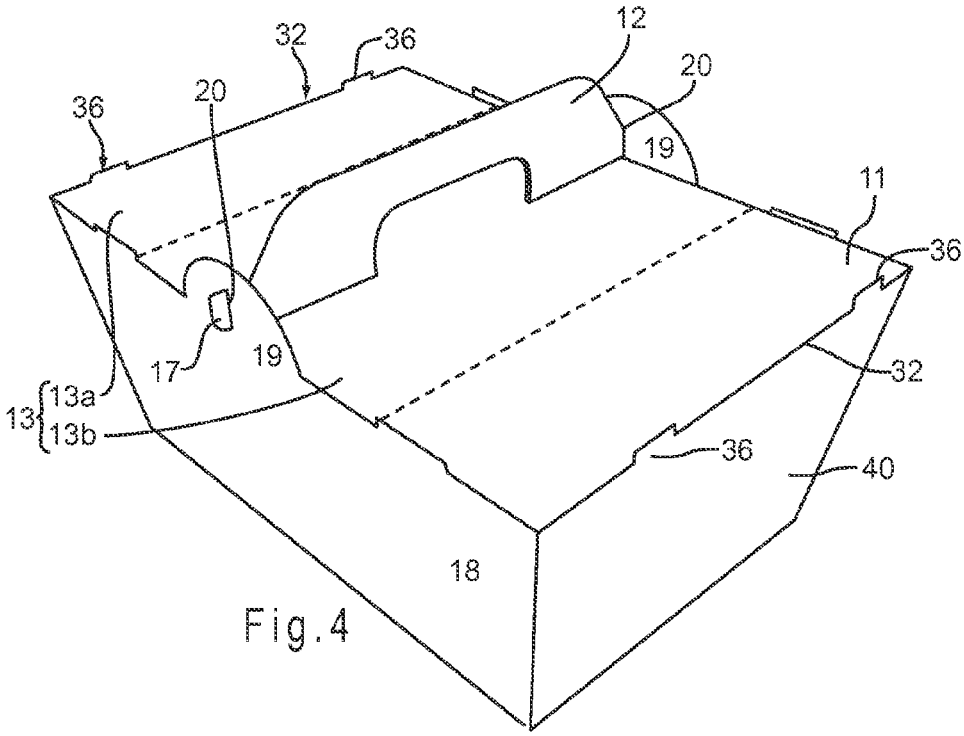
FIG. 4 is a perspective view of a second embodiment of the present invention with the lid closed.
Figure 9:
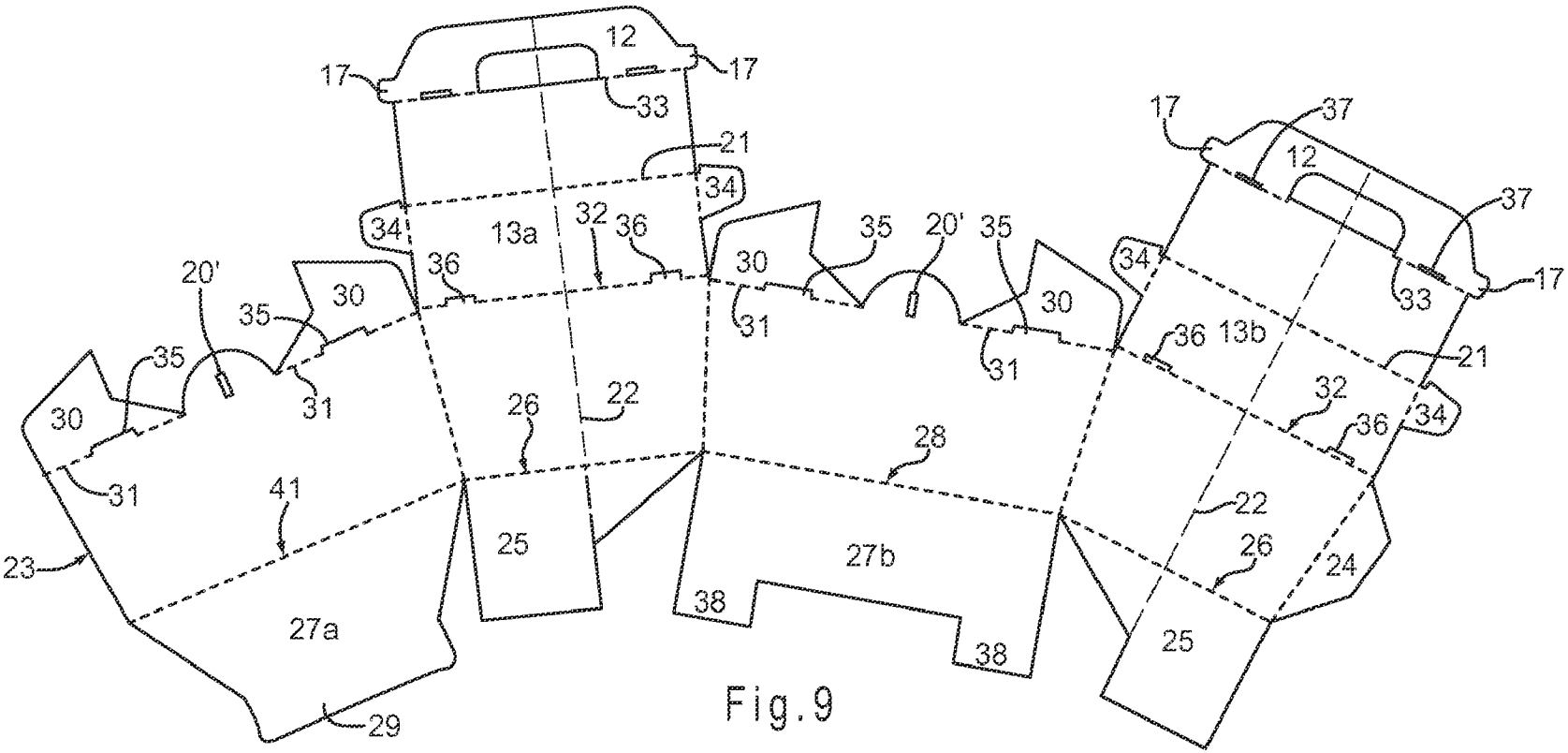
FIG. 9 is plan view of a blank used to form a first container.
Figure 19:
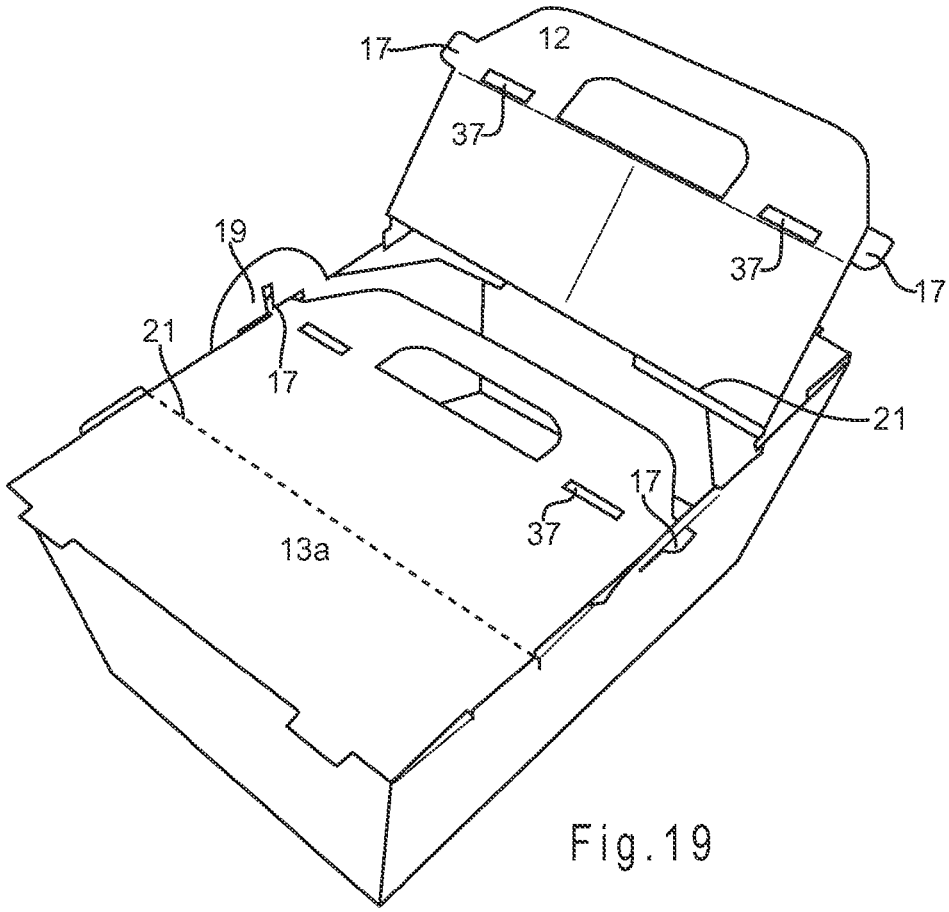
FIG. 19 is a perspective view of a first container showing one of the handles folded flat.
Figure 20:
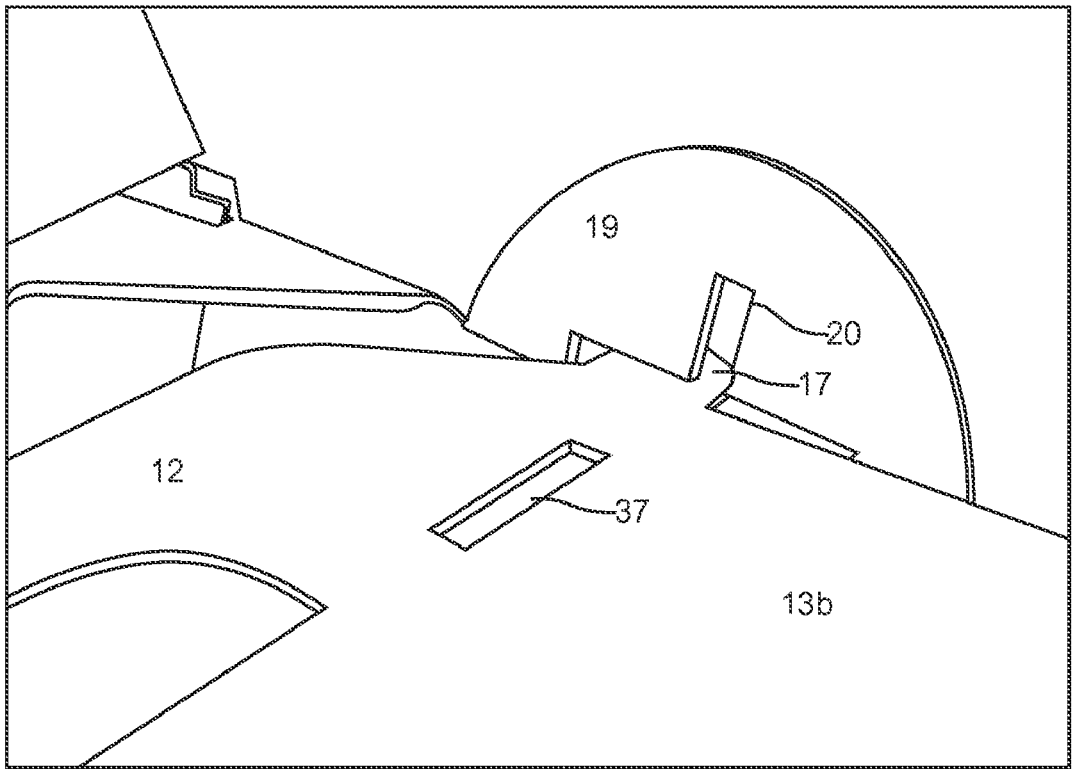
FIG. 20 is a close-up perspective view of a first container showing the configuration of FIG. 19.
Figure 21:
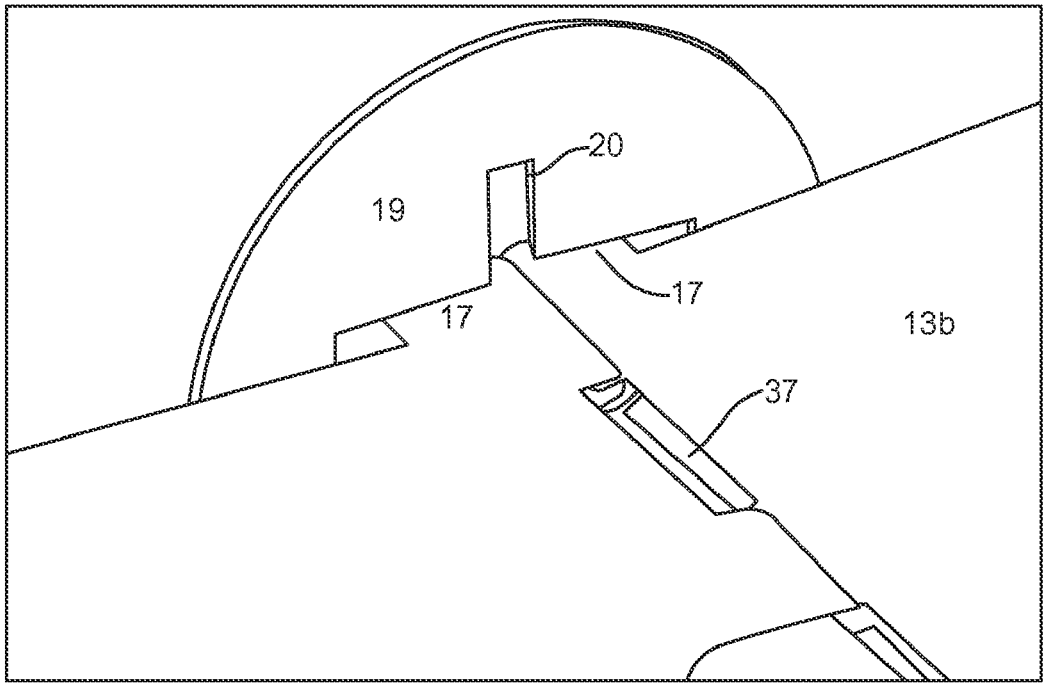
FIG. 21 is a close-up perspective view of a first container with both handles folded flat; and, FIG. 22 is a perspective view of two dispensers of the present invention stacked on top of each other.
Figure 22:
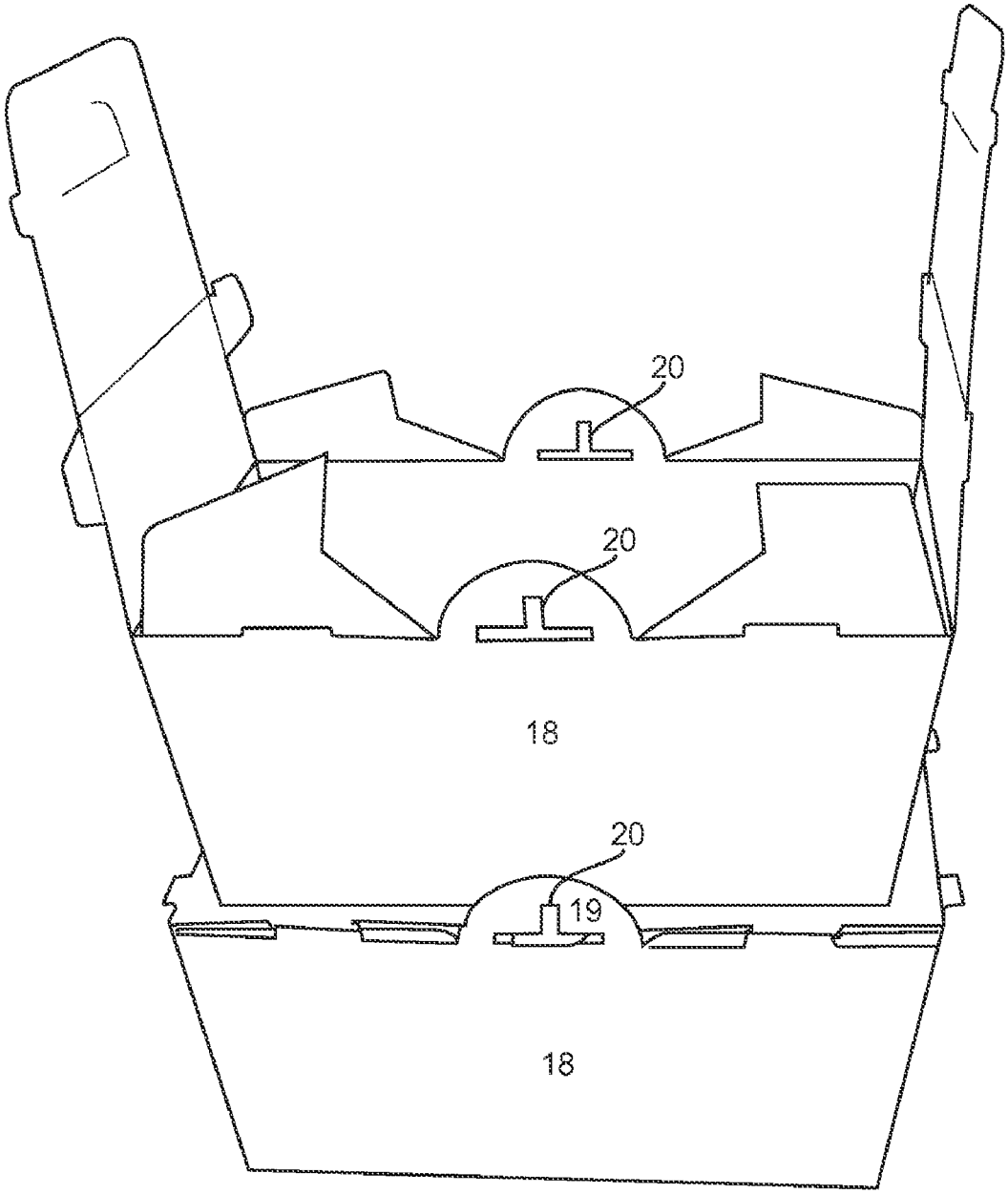

The slots 20 in tabs 19 can be an inverted T-shape, as shown in the embodiment of FIGS. 1 and 2, or can be a single vertical line 20', as shown in the embodiment of FIGS. 4 and 9. The inverted T-shape shown in FIG. 1 accommodates tabs 19 not only in a vertical position (FIG. 2), but also in a horizontal position that allows the handles 12 to lie flat, as shown in FIGS. 19-21. To do so, flap 13*a* is folded inward and its pair of tabs 17 are inserted into slots 20. Flap 13*b* is then folded inward and its tabs 17 are inserted into slots 20. By folding the handles 12 flat, one can stack a number of portable food dispensers 10 on top of each other without the handles 12 being in the way, as shown in FIG. 22. When a number of portable food dispensers 10 are stacked on top of each other, the tabs 19 stick up on either side of the stacked dispensers 10 to help orient and stabilize the stack of dispensers. Alternatively, handles 12 are not necessary and can be left off if desired.

Figure 8:
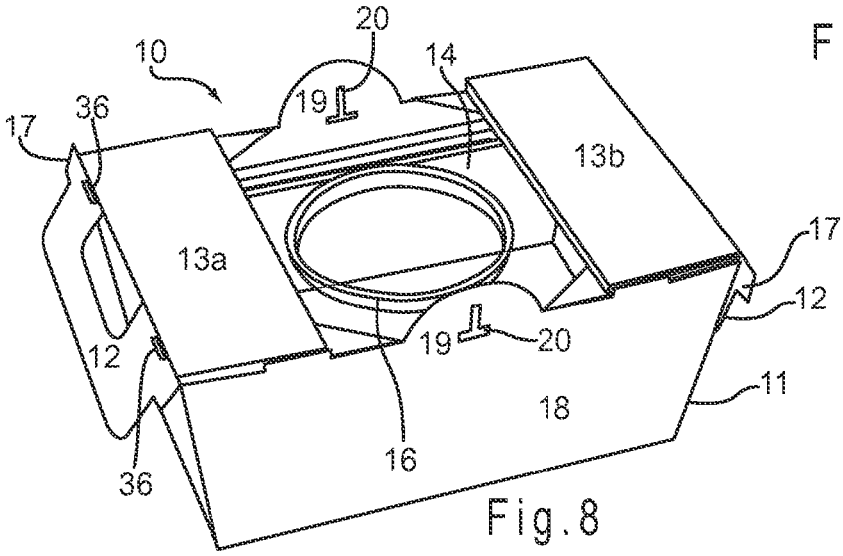
FIG. 8 is a perspective view a dispenser of the present invention with the lid partially open.
Figure 18:
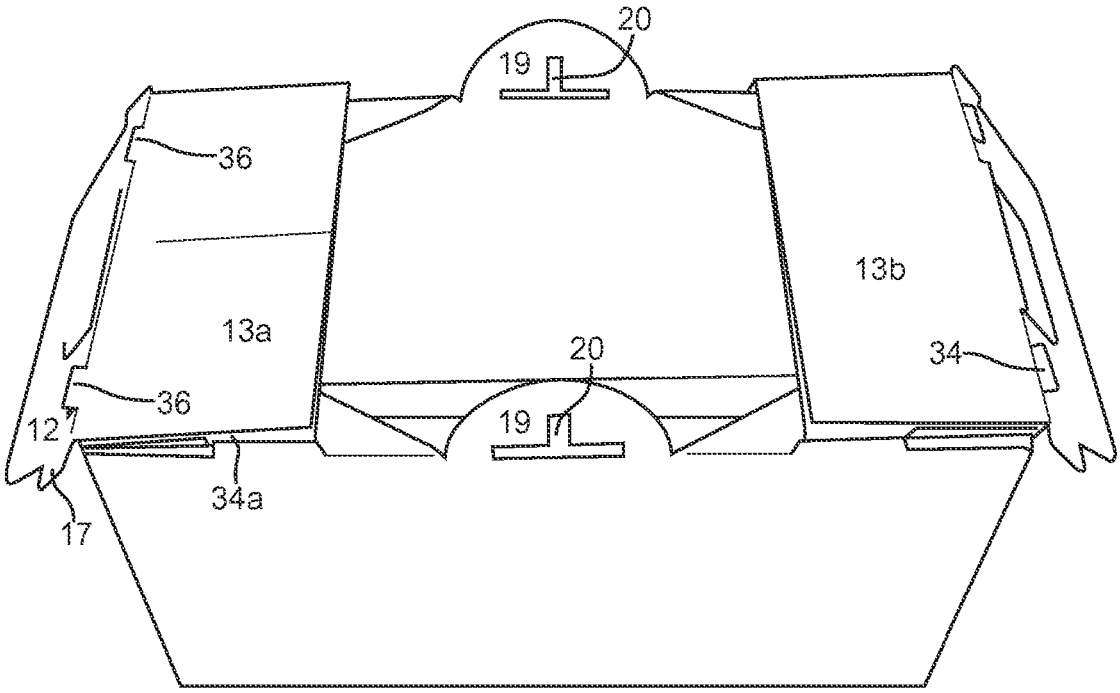
FIG. 18 is a perspective view of a first container with portions of the lid folded back.

The filled portable food dispenser 10 is then provided to the customer. The customer is able to access and serve the food as follows. The lid 13 is opened to provide access to the food in one of two ways. The lid 13 can be opened all the way, as shown in FIGS. 1 and 3, or only partially, as shown in FIGS. 8 and 18. The lid 13 is opened all the way by disengaging tabs 17 and 34 from slots 20 and 35, respectively, and then folding flaps 13*a* and 13*b* at least 90-degrees outward (preferably at least 180-degrees) along fold lines 32 (see FIGS. 1 and 3). The lid 13 may be partially opened by folding flaps 13*a* and 13*b* outward 180-degrees along fold lines 21. After flaps 13*a* and 13*b* are folded back, they can be secured to the first container by friction fitting tabs 36 into slots 37 (see FIGS. 8 and 18). In the embodiment shown in FIGS. 1, 2, and 15-18, tabs 36 extend horizontally from flaps 13*a* and 13*b*. In the embodiment shown in FIGS. 3 and 4 the tabs 36 extend vertically from the end walls 40. Alternatively, corresponding sets of tabs 36 and slots 37 can be located elsewhere around the edge of the first container in order to secure the lid 13 when it is folded back. An advantage of opening the lid 13 only partially is that heat is prevented from leaving, or entering, the container.

If no cover 15 has been used on the second container 14, then the food is ready to serve after the lid 13 has been opened. If a cover 15 has been used, then the cover 15 should be removed. Alternatively, a cap 16 can be used in the cover 15 (see FIGS. 5 and 6). Cap 16 is removed to reveal an opening 42 in the cover 15 that provides access to the food without removing the entire cover 15. It is desirable to remove cap 16, instead of removing the entire cover 15, in order to help prevent heat from leaving, or entering, the container.

The above-described uses of the present invention make use of two containers. Alternatively, the first container 11 could be used on its own, without a second container 14, depending on the type of food at issue and the type of material used to construct the first container 11. For example, if the food at issue is not very liquid, and/or the material used to construct the first container 11 is sufficiently strong, one may be able to use the first container 11 on its own without a second container 14.

Having described the general use and operation of the preferred embodiments above, the formation and construction of the portable food dispenser 10 will be described below. Preferably, the first container 11 is made of cardboard. However, any desired material can be used to form the first container 11 of the present invention. Generally, the chosen material should be sufficiently strong and durable, and, most preferably, be able to insulate the food contained therein. Exemplary, non-limiting materials that can be used to form the first container are cardboard, paperboard, plastic, corrugated plastic, cloth, and metal. The blank 21 that is used to form the embodiment of the first container 11 shown in FIGS. 3 and 4 is shown in FIG. 9 and is preferably die-cut from a sheet of cardboard (i.e., corrugated paperboard).

Figure 7:
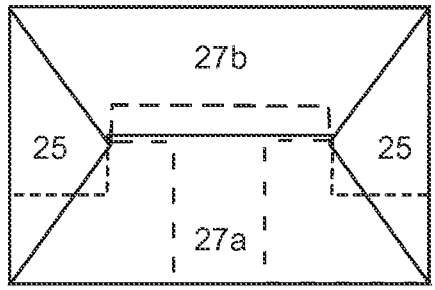
FIG. 7 is a plan view of the bottom of an assembled first container.
Figure 10:
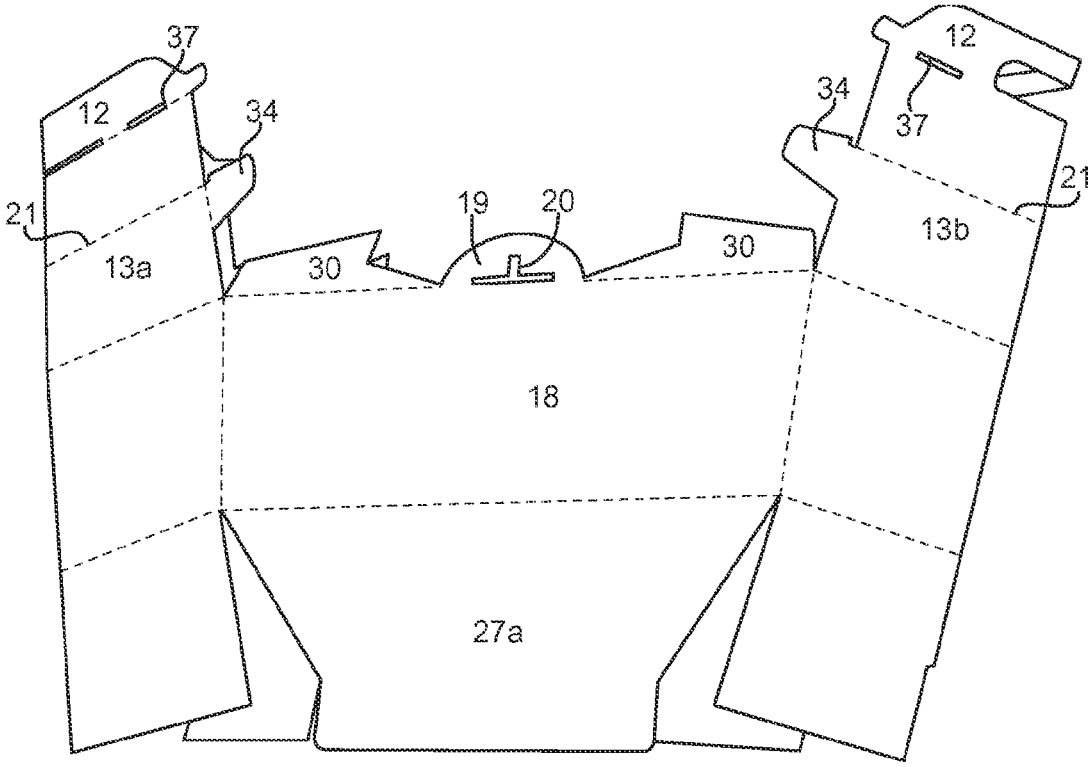
FIG. 10 is a perspective view of a first container before assembly.
Figure 11:
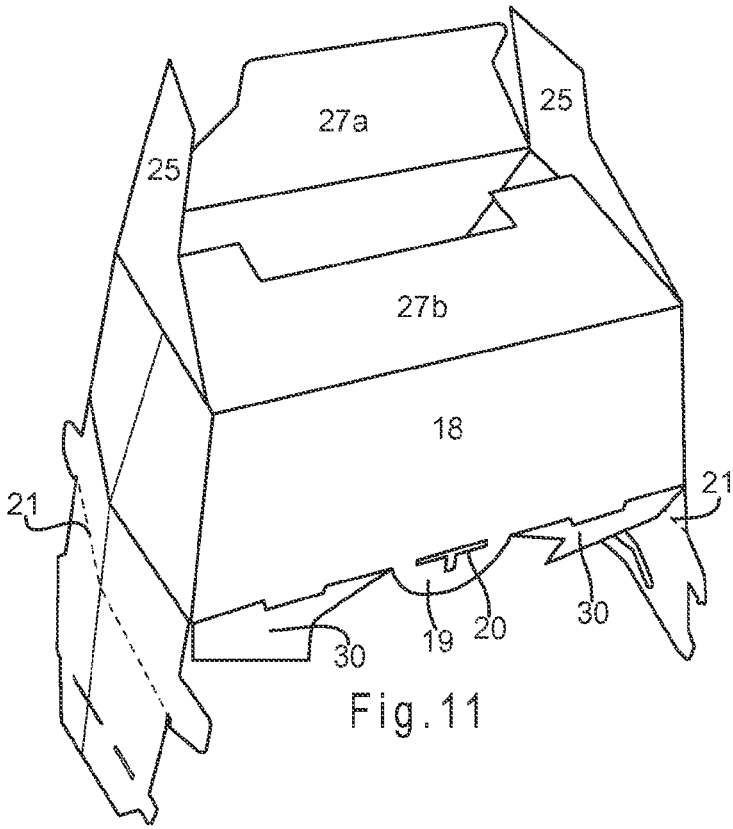
FIG. 11 is a perspective view of a first container during assembly.
Figure 12:
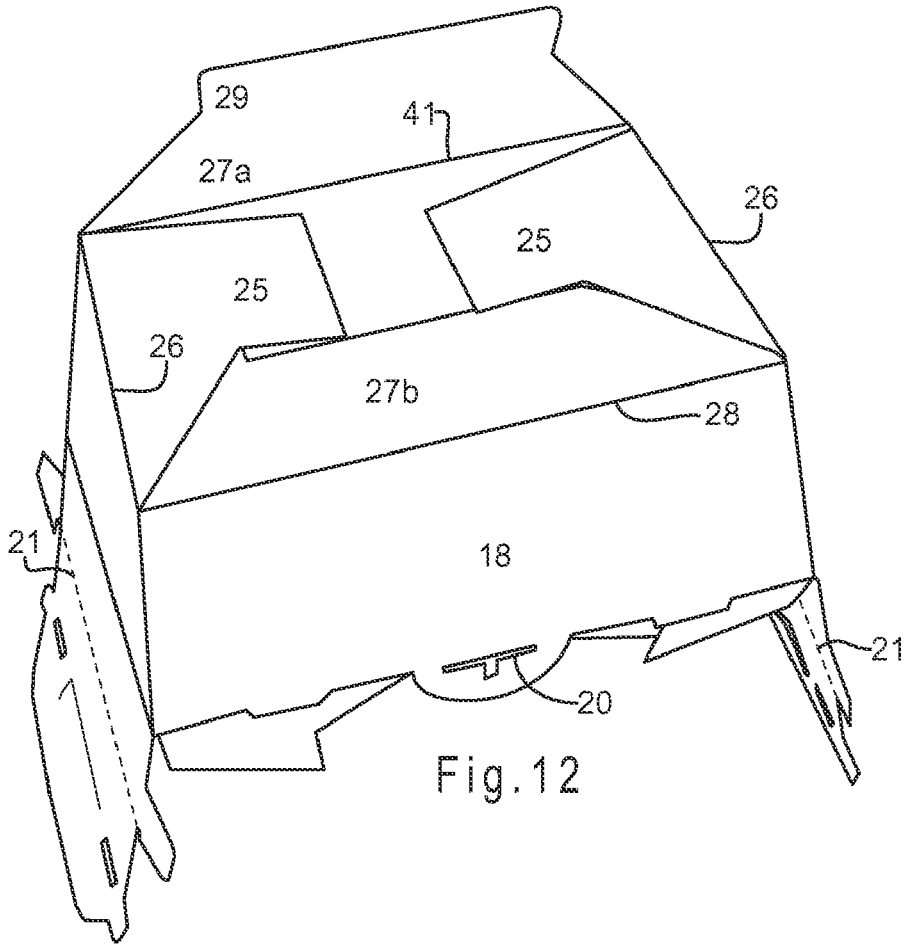
FIG. 12 is a perspective view of a first container during assembly.
Figure 13:
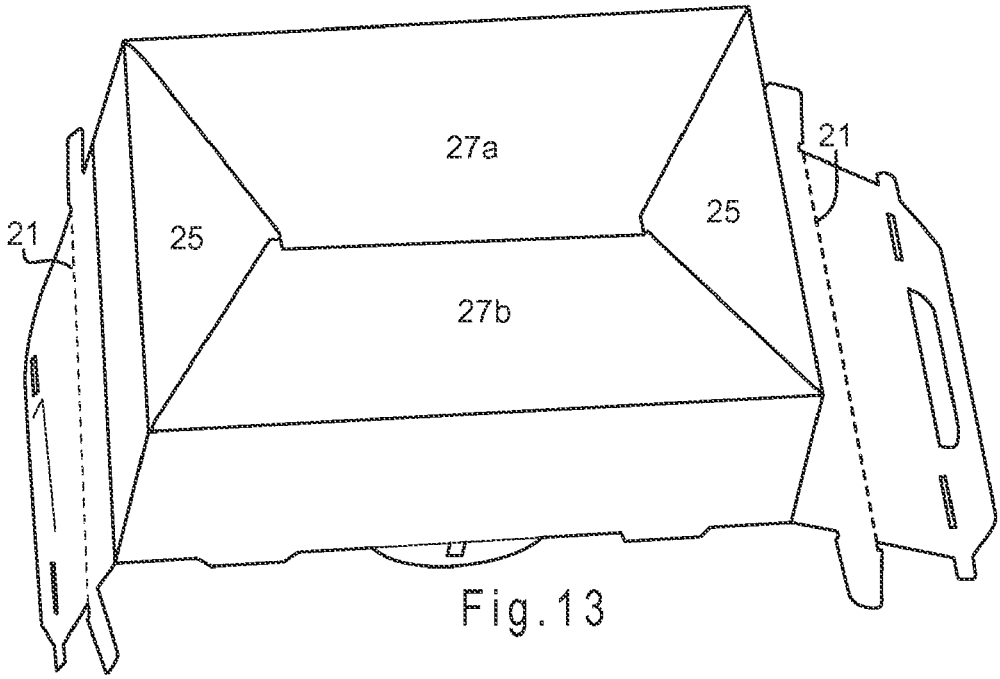
FIG. 13 is a perspective view of a first container during assembly.

The blank 21 is formed into the first container 11 as follows. After the blank 21 is die-cut from the sheet of cardboard, the left and right sides of the blank 21 are rotated 180-degrees toward each other about fold lines 22 so that edge 23 overlaps glue flap 24 (see FIG. 10). A bead of glue is placed between glue flap 24 to secure edge 23 to glue flap 24 and allowed to dry. After edge 23 is secured to glue flap 24, the left and right edges of the blank 21 (i.e., the edges corresponding to fold lines 22) are pushed toward each other so that the sides 18 of the first container 11 move away from each other. Bottom panel 27*b* is rotated 90-degrees inward about fold line 28 (see FIG. 11). Bottom flaps 25 are then rotated 90-degrees inward about fold lines 26 (see FIG. 12). Bottom panel 27*a* is rotated 90-degrees inward about fold line 41 and bottom tab 29 is inserted under bottom panel 27*b* (see FIGS. 7 and 13). In this manner, the bottom panels 27*a* and 27*b* interlock with each other to form a sturdy bottom to the first container 11. FIGS. 7 and 13 are bottom views of an assembled first container 11 and depict the interlocking relationship of the bottom flaps 25 and panels 27*a* and 27*b*.

To close the top of the first container 11, support tabs 30 are rotated 90-degrees inward about fold lines 31. Flaps 13*a* and 13*b* are then rotated 90-degrees inward about fold lines 32 and handles 12 are rotated upward 90-degrees about fold lines 33. Tabs 17 fit in slots 20 and locking tabs 34 fit in locking slots 35 (see FIG. 16). In this manner, the lid 13 is secured in place and a secure, sturdy first container 11 is formed. When handles 12 are rotated upward, they lie flat next to teach other and function together as a single handle (see FIGS. 2 and 4).

The preferred embodiments of the first container 11 shown in FIGS. 2 and 4 have a top-to-bottom shape of an inverted trapezoid. The first container 11, however, can have any desired shape without compromising the benefits and advantages of the present invention. For example, the first container could have the shape of a regular trapezoid (i.e., the narrow end is on top). Such a shape, when used with the second container shown in FIG. 5, would create a space below the rim of the second container for fingers or a tool to reach in and remove the second container 14 from the first container 11. Alternatively, the first container 11 could have a top-to-bottom shape that is square or any other acceptable shape. Likewise, the shape of the footprint of the first containers 11 shown in FIGS. 2 and 4 are rectangular, but it could also be square, circular, an oval or any other acceptable shape.

Figure 6:
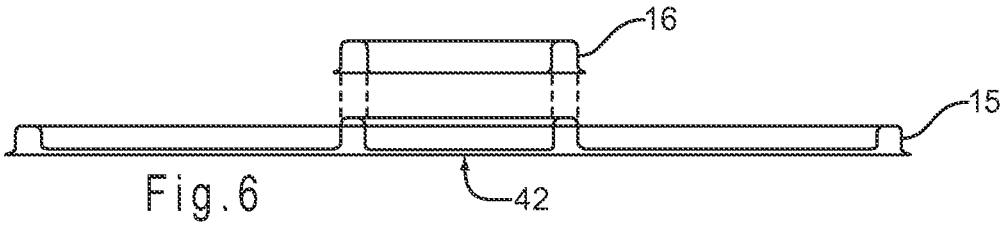
FIG. 6 is a side view of a cover and cap.
Figure 14:
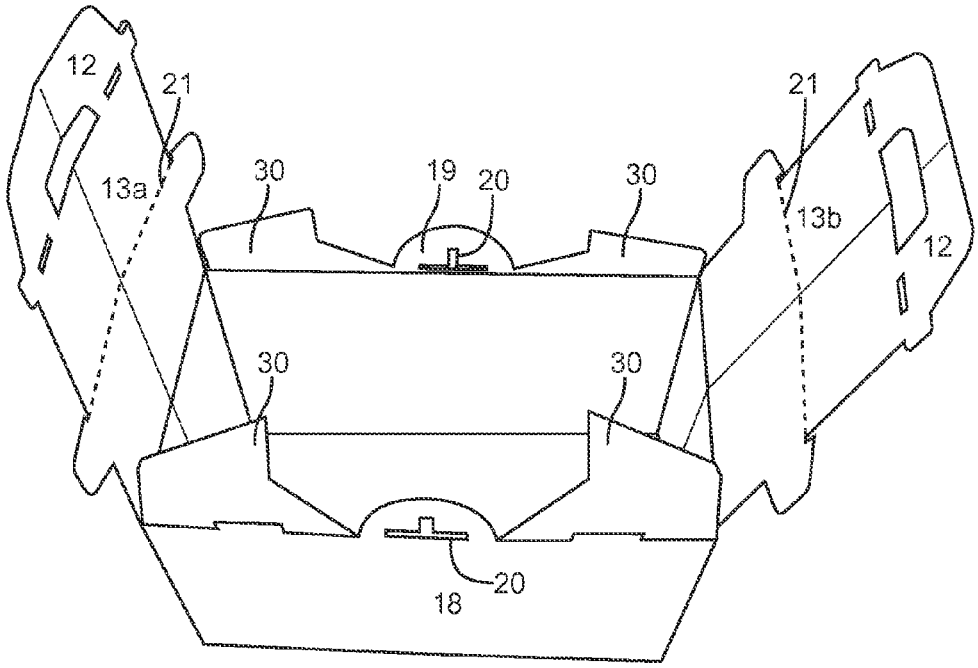
FIG. 14 is a perspective view of an assembled first container with the lid open.
Figure 15:
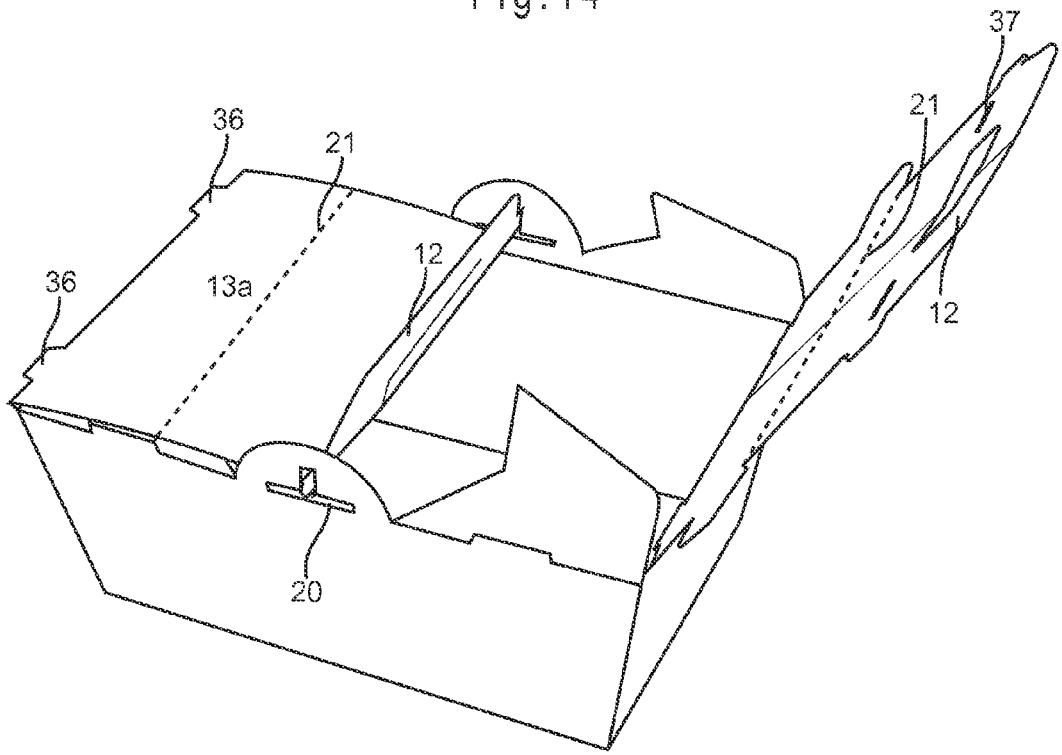
FIG. 15 is a perspective view of a first container during the closing of the lid.
Figure 16:
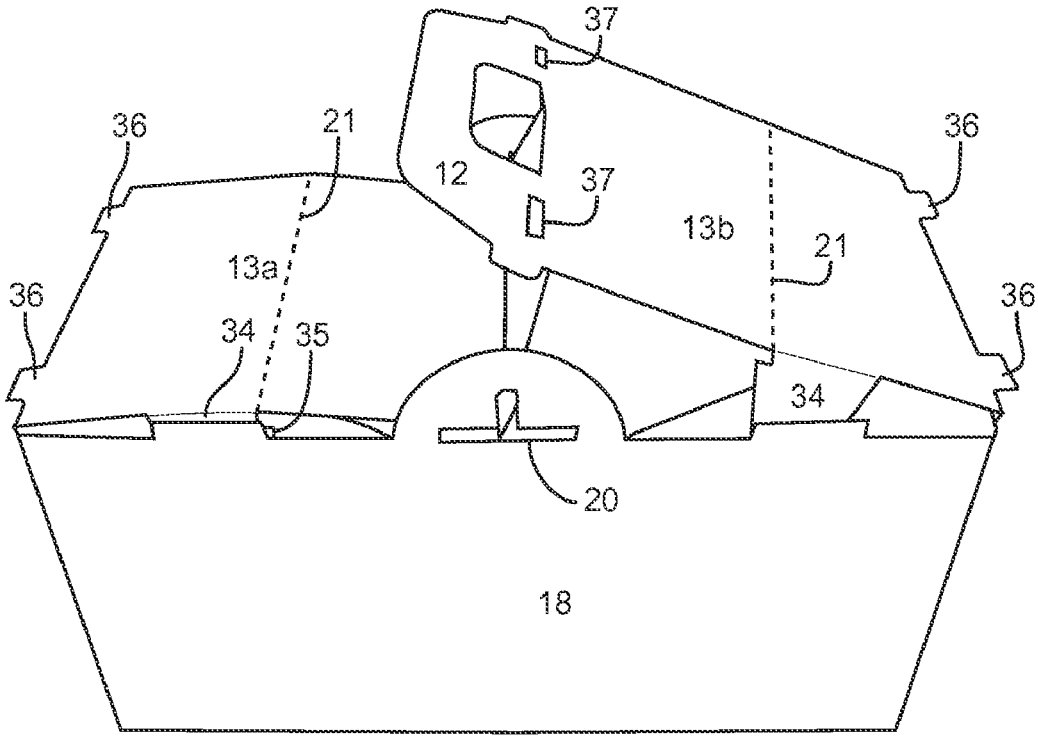
FIG. 16 is a perspective view of a first container during the closing of the lid.
Figure 17:
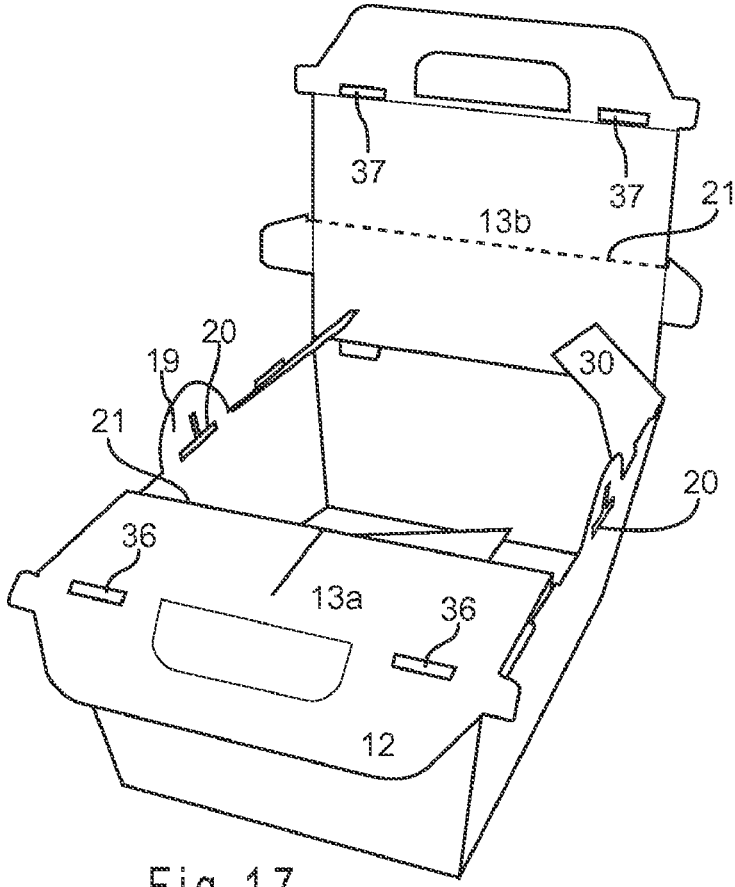
FIG. 17 is a perspective view of a partially open first container.

A preferred embodiment of the second container 14 is shown in FIGS. 6-7. The second container 14 is intended to hold the food securely and safely for transport to the end user. It is preferred that the second container 14 fits snugly inside the first container 11 so that the second container 14 does not shift or move within the first container 11 during transit. For example, the first containers 11 of FIGS. 1 and 3 have an inverted trapezoid shape so that when the second container 14 is placed inside the first container 11, a snug, friction fit is created between the top edge 39 of the second container 14 and the side walls of the first container 11. The inverted trapezoid shape is also beneficial because the partially assembled first containers 11 (see FIG. 14) can be nested and stacked inside of each other (not shown). It is also preferred that the second container 14 be of the same shape and size as the first container 11 so that food does not spill out and become trapped between the first container 11 and second container 14, as would result if the containers were of different sizes and shapes.

The second container 14 is preferably made from thermoformed polyethylene, but any material that can be used to hold a food product can be used to form the second container 14 of the present invention. Exemplary, non-limiting examples of materials that can be used to form the second container 14 are plastics (e.g., polystyrene, polycarbonate, polypropylene, low density polyethylene (LDPE), linear low density polyethylene (LLDPE), and very low density polyethylene (VLDPE)), metals (e.g., aluminum, steel, and copper), wood, and paperboard (corrugated and non-corrugated, coated and non-coated). If plastic is used to make the second container 14, the container 14 is preferably thermoformed. Alternatively, the container 14 can be injection molded, blow molded, or rotomolded.

The second container 14 has rounded bottom corners so that a liquid, such as soup or the like, can be easily removed from the container with a ladle or spoon without leaving behind food that might otherwise be stuck in a corner. The corners of the second container 14 could also be square, or any other shape that is desired.

Figure 5:
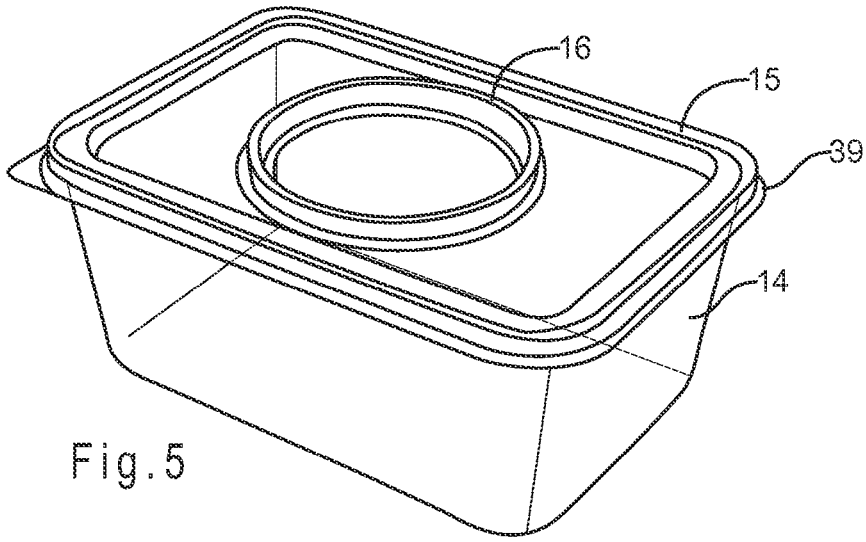
FIG. 5 is a perspective view of an embodiment of a second container.

The preferred second container 14 includes a cover 15, as shown in FIGS. 5 and 6. Centrally located in the middle of cover 15 is a cap 16. Cap 16 fits over an opening 42 in the middle of cover 15 and contains a contoured peripheral edge that mates, via a friction fit, to the contoured edge of the opening in the cover 15 (see FIG. 6). In this manner, the cap 16 can snap on and off the cover 15 as desired. Cap 16 provides an easy means of accessing the contents of the second container 14 without removing the entire cover 15 and affecting the temperature of the food contained therein. The opening 42 in the cover 15 should be large enough to accommodate a serving utensil, such as a spoon or ladle. Cover 15 has a contoured peripheral edge that snaps onto (i.e., friction fits) the top rim of the second container 14 in the same or similar manner that the cap 16 snaps onto the cover 15.

The cap 16 shown in the embodiment of FIG. 5 is circular. Alternatively, the cap 16 (and its corresponding opening in the cover 15) can be any desired shape, such as square, rectangular, triangular, etc. For example, the cap 16 in the embodiment of FIG. 3 is approximately square. Cover 15 and cap 16 are preferably made of the same material, and in the same manner, as second container 14.

The cover 15 shown in the preferred embodiments of FIGS. 3 and 5 includes a re-attachable cap 16. In another embodiment, the cover 15 could be used without a cap 16. In yet another embodiment, the cover 16 could include a perforated outline of the desired opening so the end user could tear off the perforated section and create an opening in that manner.

The first containers 11 and second containers 14 shown in the embodiments of FIGS. 1-22 are designed to hold approximately one gallon of food. The first and second containers, however, can be designed to accommodate whatever amount of food is desired.

While particular embodiments of the present invention have been illustrated and described above, the present invention should not be limited to such examples and descriptions. It should be apparent that changes and modifications may be incorporated and embodied as part of the present invention within the scope of the following claims.

We claim:

1. A method of transporting an item in a container, comprising:

a. providing a first container that comprises a pair of container slots, multiple pairs of container tabs, a lid, having a first section and a second section, that is integral to the first container and configured to operate between a first position and a second position, and a handle formed from the first section and the second section of the lid, where each of the first section and the second section of the lid comprise a pair of handle tabs and a pair of handle slots;

b. providing the lid of the first container that is capable of having a first pair of the multiple pairs of container tabs inserted into the pair of handle slots from the first section of the lid and a second pair of the multiple pairs of container tabs inserted into the pair of handle slots from the second section of the lid to secure the lid in the first position and to provide access to a potion of the first container; and c. placing a second container in the first container.

2. The method of claim 1 further comprising securing the lid in the first position, to provide access to a portion of the second container, by inserting the first pair of the multiple pairs of container tabs into the pair of handle slots from the first section of the lid and inserting the second pair of the multiple pairs of container tabs into the pair of handle slots from the second section of the lid.

3. The method of claim 2 further comprising disengaging each of the multiple pairs of container tabs from the pair of handle slots, and securing the lid in the second position by inserting the pair of handle tabs into the pair of container slots.

4. The method of claim 3 further comprising folding the handle flat upon a portion of the lid.

5. The method of claim 1 further comprising removing a portion of a cover to the second container to provide access to an interior of the second container.

6. The method of claim 1 further comprising removing a cover to the second container to provide access to an interior of the second container.

7. The method of claim 1 further comprising providing the lid of the first container that is capable of having the pair of handle tabs inserted into the pair of container slots to secure the lid in the second position.

* * * * *

UNITED STATES PATENT AND TRADEMARK OFFICE

CERTIFICATE OF CORRECTION

PATENT NO. : 8,015,780 B2
APPLICATION NO. : 12/558974
DATED : September 13, 2011
INVENTOR(S) : Matthew R. Cook et al.

It is certified that error appears in the above-identified patent and that said Letters Patent is hereby corrected as shown below:

In the Claims

In column 6, claim 1, line 25, after "provide access to a" replace "potion" with --portion--.

Signed and Sealed this
Twentieth Day of December, 2011

David J. Kappos

David J. Kappos
*Director of the United States Patent and Trademark Office*